US008401151B2

(12) United States Patent
Frontera et al.

(10) Patent No.: US 8,401,151 B2
(45) Date of Patent: Mar. 19, 2013

(54) X-RAY TUBE FOR MICROSECOND X-RAY INTENSITY SWITCHING

(75) Inventors: Mark Alan Frontera, Ballston Lake, NY (US); Yun Zou, Clifton Park, NY (US); Peter Andras Zavodszky, Clifton Park, NY (US); Sergio Lemaitre, Whitefish Bay, WI (US); Carey Shawn Rogers, Brookfield, WI (US)

(73) Assignee: General Electric Company, Niskayuna, NY (US)

( * ) Notice: Subject to any disclaimer, the term of this patent is extended or adjusted under 35 U.S.C. 154(b) by 409 days.

(21) Appl. No.: 12/639,206

(22) Filed: Dec. 16, 2009

(65) Prior Publication Data

US 2011/0142193 A1 Jun. 16, 2011

(51) Int. Cl.
*H01J 35/14* (2006.01)

(52) U.S. Cl. ..... 378/138; 378/136; 378/137

(58) Field of Classification Search ..... 378/136–138
See application file for complete search history.

(56) References Cited

U.S. PATENT DOCUMENTS

| | | | | |
|---|---|---|---|---|
| 2,559,526 | A * | 7/1951 | Van De Graaff et al. | 378/121 |
| 3,710,176 | A | 1/1973 | Schlesinger | |
| 4,213,048 | A | 7/1980 | Quang et al. | |
| 4,458,180 | A | 7/1984 | Sohval et al. | |
| 4,631,742 | A | 12/1986 | Oliver | |
| 4,912,367 | A | 3/1990 | Schumacher et al. | |
| 5,199,054 | A * | 3/1993 | Adams et al. | 378/21 |
| 5,332,945 | A | 7/1994 | True | |
| 5,438,605 | A * | 8/1995 | Burke et al. | 378/135 |
| 5,617,464 | A * | 4/1997 | Mika et al. | 378/137 |
| 5,812,632 | A * | 9/1998 | Schardt et al. | 378/137 |
| 6,091,799 | A * | 7/2000 | Schmidt | 378/137 |
| 6,094,009 | A | 7/2000 | Goebel | |
| 6,570,165 | B1 * | 5/2003 | Engdahl et al. | 250/423 P |
| 6,652,143 | B2 | 11/2003 | Popescu | |
| 6,785,359 | B2 | 8/2004 | Lemaitre | |
| 6,816,573 | B2 * | 11/2004 | Hirano et al. | 378/114 |
| 6,912,268 | B2 * | 6/2005 | Price et al. | 378/122 |
| 6,944,268 | B2 * | 9/2005 | Shimono | 378/111 |
| 7,110,500 | B2 * | 9/2006 | Leek | 378/111 |
| 2001/0038263 | A1 * | 11/2001 | Lee et al. | 313/542 |
| 2002/0180364 | A1 | 12/2002 | Ratzinger et al. | |
| 2003/0099327 | A1 * | 5/2003 | Matsushita et al. | 378/138 |
| 2004/0240616 | A1 * | 12/2004 | Qiu et al. | 378/136 |
| 2007/0053495 | A1 * | 3/2007 | Morton et al. | 378/136 |

(Continued)

FOREIGN PATENT DOCUMENTS

| | | | |
|---|---|---|---|
| EP | 2077574 | A1 | 7/2009 |
| JP | 2007051326 | A | 3/2007 |

(Continued)

OTHER PUBLICATIONS

JW Jack and T Smith; "A pulsed X-ray generator"; W Jack et al 1973 J. Phys. E: Sci. Instrum. 6 162-164.

*Primary Examiner* — Thomas R Artman
(74) *Attorney, Agent, or Firm* — Marie-Claire B. Maple

(57) ABSTRACT

An injector for an X-ray tube is presented. The injector includes an emitter to emit an electron beam, at least one focusing electrode disposed around the emitter, wherein the at least one focusing electrode focuses the electron beam and at least one extraction electrode maintained at a positive bias voltage with respect to the emitter, wherein the at least one extraction electrode controls an intensity of the electron beam.

23 Claims, 3 Drawing Sheets

U.S. PATENT DOCUMENTS

| | | | | |
|---|---|---|---|---|
| 2008/0043920 | A1* | 2/2008 | Liu et al. | 378/138 |
| 2008/0067377 | A1 | 3/2008 | Hatakeyama et al. | |
| 2008/0187093 | A1* | 8/2008 | Price et al. | 378/19 |
| 2010/0128846 | A1* | 5/2010 | Balakin | 378/62 |
| 2011/0142193 | A1* | 6/2011 | Frontera et al. | 378/16 |

FOREIGN PATENT DOCUMENTS

| | | | |
|---|---|---|---|
| WO | 2006064403 | A2 | 6/2006 |
| WO | 2007135614 | A1 | 11/2007 |
| WO | 2009127995 | A1 | 10/2009 |

* cited by examiner

X-RAY TUBE FOR MICROSECOND X-RAY INTENSITY SWITCHING

BACKGROUND

Embodiments of the present invention relate generally to X-ray tubes and more particularly to an apparatus for microsecond X-ray intensity switching.

Typically, in computed tomography (CT) imaging systems, an X-ray source emits a fan-shaped beam or a cone-shaped beam towards a subject or an object, such as a patient or a piece of luggage. Hereinafter, the terms "subject" and "object" may be used to include anything that is capable of being imaged. The beam, after being attenuated by the subject, impinges upon an array of radiation detectors. The intensity of the attenuated beam radiation received at the detector array is typically dependent upon the attenuation of the X-ray beam by the subject. Each detector element of a detector array produces a separate electrical signal indicative of the attenuated beam received by each detector element. The electrical signals are transmitted to a data processing system for analysis. The data processing system processes the electrical signals to facilitate generation of an image.

Generally, in CT systems the X-ray source and the detector array are rotated about a gantry within an imaging plane and around the subject. Furthermore, the X-ray source generally includes an X-ray tube, which emits the X-ray beam at a focal point. Also, the X-ray detector or detector array typically includes a collimator for collimating X-ray beams received at the detector, a scintillator disposed adjacent to the collimator for converting X-rays to light energy, and photodiodes for receiving the light energy from the adjacent scintillator and producing electrical signals therefrom.

Currently available X-ray tubes employed in CT systems fail to control the level of electron beam intensity to a desired temporal resolution. Several attempts have been made in this area by employing techniques such as controlling the heating of the filament, employing Wehnelt Cylinder gridding that is typically used in vascular X-ray sources and by employing an electron acceleration hood on the target of the X-ray tube to control electron beam intensity. Also, currently available microwave sources include an electron gun that includes a focusing electrode, such as a Pierce electrode to generate an electron beam. These electron guns typically include a grid to control a beam current magnitude via use of control grid means. Unfortunately, the energy and duty cycle of the electron beam makes the introduction of an intercepting wire mesh grid difficult since the thermo-mechanical stresses in the grid wires are reduced when the intercepted area of the electron beam is minimized. Furthermore, rapidly changing the electron beam current prevents proper positioning and focusing of the electron beam on the X-ray target. Modulation of the electron beam current from 0 percent to 100 percent of the electron beam intensity changes the forces in the electron beam, due to changes in the space charge force resulting in change in the desired electro-magnetic focusing and deflection. Hence, it is desirable to control focus and position of the electron beam on a same time scale to preserve image quality, imaging system performance, and durability of the X-ray source.

It is further desirable to develop a design of an X-ray tube to control electron beam intensity based on scanning requirements and accurately position the electron beam.

BRIEF DESCRIPTION

Briefly in accordance with one aspect of the present technique, an injector for an X-ray tube is presented. The injector includes an emitter to emit an electron beam, at least one focusing electrode disposed around the emitter, wherein the at least one focusing electrode focuses the electron beam and at least one extraction electrode maintained at a positive bias voltage with respect to the emitter, wherein the at least one extraction electrode controls an intensity of the electron beam.

In accordance with another aspect of the present technique, an X-ray tube is presented. The X-ray tube includes an injector including an emitter to emit an electron beam, at least one focusing electrode disposed around the emitter, wherein the at least one focusing electrode focuses the electron beam and at least one extraction electrode for controlling an intensity of the electron beam, wherein the at least one extraction electrode is maintained at a positive bias voltage with respect to the emitter. Further, the X-ray tube also includes a target for generating X-rays when impinged upon by the electron beam and a magnetic assembly located between the injector and the target for directionally influencing focusing, deflecting and/or positioning the electron beam towards the target.

In accordance with a further aspect of the present technique, a computed tomography system is presented. The computed tomography system includes a gantry and an X-ray tube coupled to the gantry. The X-ray tube includes a tube casing and an injector including an emitter to emit an electron beam, at least one focusing electrode disposed around the emitter, wherein the at least one focusing electrode focuses the electron beam and at least one extraction electrode for controlling an intensity of the electron beam, wherein the at least one extraction electrode is maintained at a positive bias voltage with respect to the emitter. The X-ray tube also includes a target for generating X-rays when impinged upon by the electron beam and a magnetic assembly located between the injector and the target for directionally influencing focusing deflecting and/or positioning the electron beam towards the target. Further, the computed tomography system includes an X-ray controller for providing power and timing signals to the X-ray tube and one or more detector elements for detecting attenuated X-ray beam from an imaging object.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Embodiments of the present invention relate to microsecond X-ray intensity switching in an X-ray tube. An exemplary X-ray tube and a computed tomography system employing the exemplary X-ray tube are presented.

Figure 1:
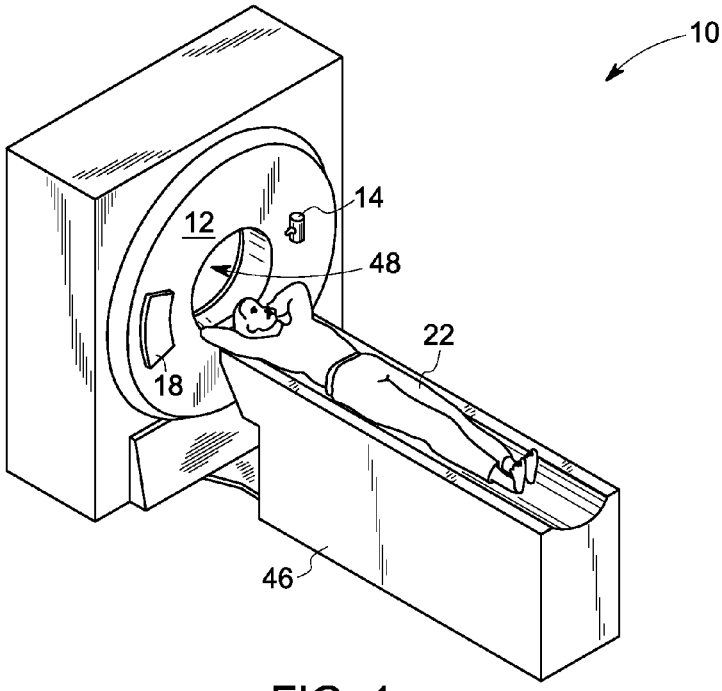
FIG. 1 is a pictorial view of a CT imaging system.
Figure 2:
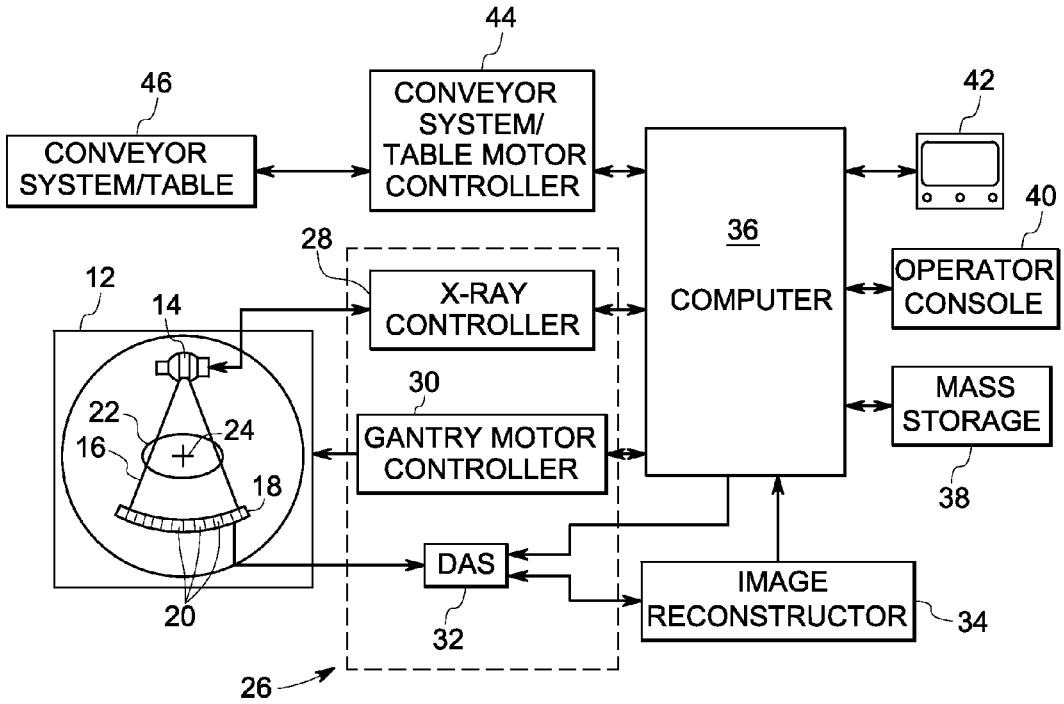
FIG. 2 is a block schematic diagram of the CT imaging system illustrated in FIG. 1.

Referring now to FIGS. 1 and 2, a computed tomography (CT) imaging system 10 is illustrated. The CT imaging system 10 includes a gantry 12. The gantry 12 has an X-ray source 14, which typically is an X-ray tube that projects a beam of X-rays 16 towards a detector array 18 positioned opposite the X-ray tube on the gantry 12. In one embodiment, the gantry 12 may have multiple X-ray sources (along the patient theta or patient Z axis) that project beams of X-rays. The detector array 18 is formed by a plurality of detectors 20 which together sense the projected X-rays that pass through an object to be imaged, such as a patient 22. During a scan to acquire X-ray projection data, the gantry 12 and the components mounted thereon rotate about a center of rotation 24. While the CT imaging system 10 described with reference to the medical patient 22, it should be appreciated that the CT imaging system 10 may have applications outside the medical realm. For example, the CT imaging system 10 may be utilized for ascertaining the contents of closed articles, such as luggage, packages, etc., and in search of contraband such as explosives and/or biohazardous materials.

Rotation of the gantry 12 and the operation of the X-ray source 14 are governed by a control mechanism 26 of the CT system 10. The control mechanism 26 includes an X-ray controller 28 that provides power and timing signals to the X-ray source 14 and a gantry motor controller 30 that controls the rotational speed and position of the gantry 12. A data acquisition system (DAS) 32 in the control mechanism 26 samples analog data from the detectors 20 and converts the data to digital signals for subsequent processing. An image reconstructor 34 receives sampled and digitized X-ray data from the DAS 32 and performs high-speed reconstruction. The reconstructed image is applied as an input to a computer 36, which stores the image in a mass storage device 38.

Moreover, the computer 36 also receives commands and scanning parameters from an operator via operator console 40 that may have an input device such as a keyboard (not shown in FIGS. 1-2). An associated display 42 allows the operator to observe the reconstructed image and other data from the computer 36. Commands and parameters supplied by the operator are used by the computer 36 to provide control and signal information to the DAS 32, the X-ray controller 28 and the gantry motor controller 30. In addition, the computer 36 operates a table motor controller 44, which controls a motorized table 46 to position the patient 22 and the gantry 12. Particularly, the table 46 moves portions of patient 22 through a gantry opening 48. It may be noted that in certain embodiments, the computer 36 may operate a conveyor system controller 44, which controls a conveyor system 46 to position an object, such as, baggage or luggage and the gantry 12. More particularly, the conveyor system 46 moves the object through the gantry opening 48.

The X-ray source 14 is typically an X-ray tube that includes at least a cathode and an anode. The cathode may be a directly heated cathode or an indirectly heated cathode. Currently, X-ray tubes include an electron source to generate an electron beam and impinge the electron beam on the anode to produce X-rays. These electron sources control a beam current magnitude by changing the current on the filament, and therefore emission temperature of the filament. Unfortunately, these X-ray tubes fail to control electron beam intensity to a view-to-view basis based on scanning requirements, thereby limiting the system imaging options. Accordingly, an exemplary X-ray tube is presented, where the X-ray tube provides microsecond current control during nominal operation, on/off gridding for gating or usage of multiple X-ray sources, 0 percent to 100 percent modulation for improved X-ray images, and dose control or fast voltage switching for generating X-rays of desired intensity resulting in enhanced image quality.

Figure 3:
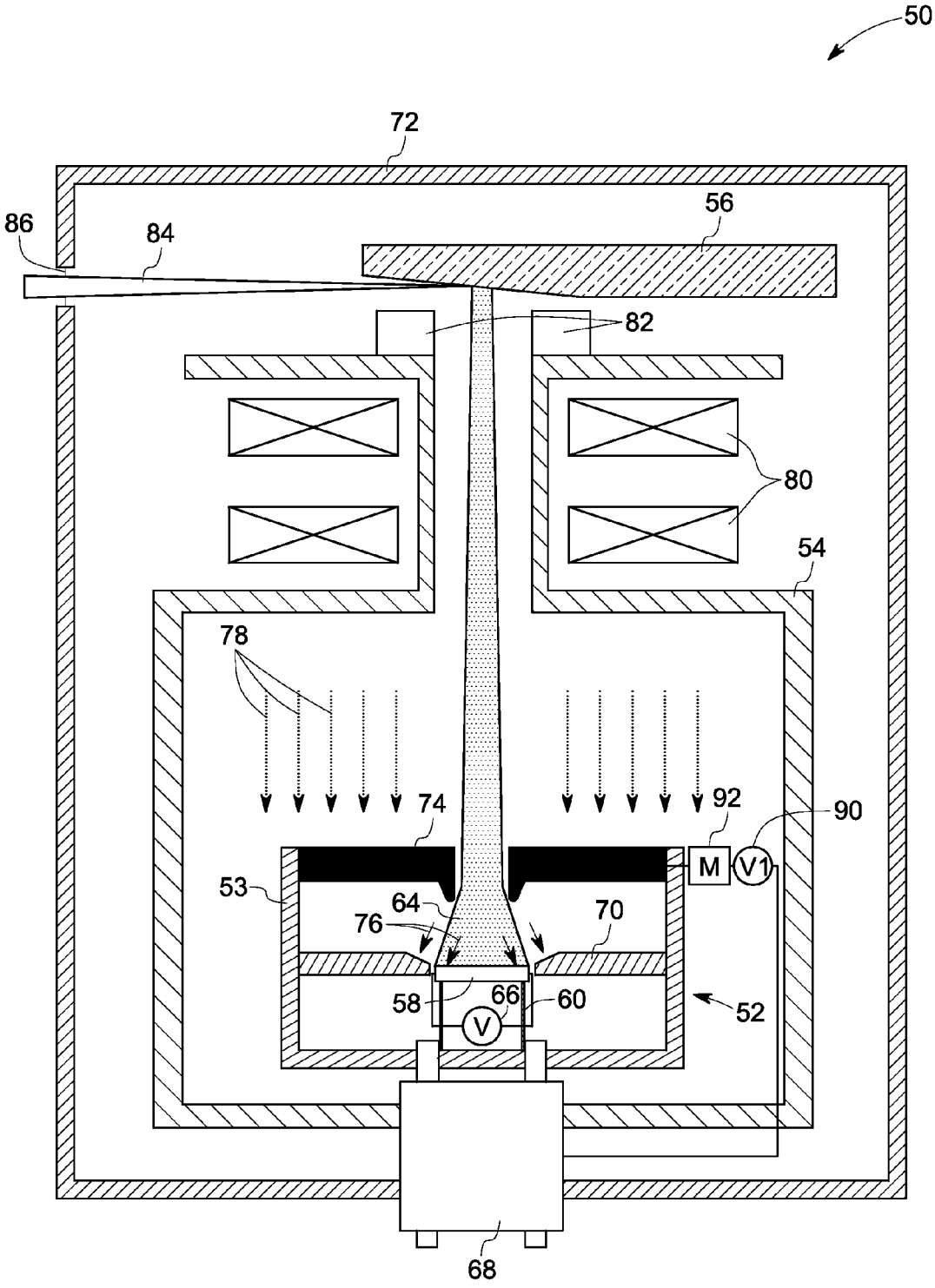
FIG. 3 is a diagrammatical illustration of an exemplary X-ray tube, in accordance with aspects of the present technique.

FIG. 3 is a diagrammatical illustration of an exemplary X-ray tube 50, in accordance with aspects of the present technique. In one embodiment, the X-ray tube 50 may be the X-ray source 14 (see FIGS. 1-2). In the illustrated embodiment, the X-ray tube 50 includes an exemplary injector 52 disposed within a vacuum wall 54. Further, the injector 52 includes an injector wall 53 that encloses various components of the injector 52. In addition, the X-ray tube 50 also includes an anode 56. The anode 56 is typically an X-ray target. The injector 52 and the anode 56 are disposed within a tube casing 72. In accordance with aspects of the present technique, the injector 52 may include at least one cathode in the form of an emitter 58. In the present example, the cathode, and in particular the emitter 58, may be directly heated. Further, the emitter may be coupled to an emitter support 60, and the emitter support 60 in turn may be coupled to the injector wall 53. The emitter 58 may be heated by passing a large current through the emitter 58. A voltage source 66 may supply this current to the emitter 58. In one embodiment, a current of about 10 amps (A) may be passed through the emitter 58. The emitter 58 may emit an electron beam 64 as a result of being heated by the current supplied by the voltage source 66. As used herein, the term "electron beam" may be used to refer to a stream of electrons that have substantially similar velocities.

The electron beam 64 may be directed towards the target 56 to produce X-rays 84. More particularly, the electron beam 64 may be accelerated from the emitter 58 towards the target 56 by applying a potential difference between the emitter 58 and the target 56. In one embodiment, a high voltage in a range from about 40 kV to about 450 kV may be applied via use of a high voltage feedthrough 68 to set up a potential difference between the emitter 58 and the target 56, thereby generating a high voltage main electric field 78. In one embodiment, a high voltage differential of about 140 kV may be applied between the emitter 58 and the target 56 to accelerate the electrons in the electron beam 64 towards the target 56. It may be noted that in the presently contemplated configuration, the target 56 may be at ground potential. By way of example, the emitter 58 may be at a potential of about −140 kV and the target 56 may be at ground potential or about zero volts.

In an alternative embodiment, emitter 58 may be maintained at ground potential and the target 56 may be maintained at a positive potential with respect to the emitter 58. By way of example, the target may be at a potential of about 140 kV and the emitter 58 may be at ground potential or about zero volts.

Moreover, when the electron beam 64 impinges upon the target 56, a large amount of heat is generated in the target 56. Unfortunately, the heat generated in the target 56 may be significant enough to melt the target 56. In accordance with aspects of the present technique, a rotating target may be used to circumvent the problem of heat generation in the target 56. More particularly, in one embodiment, the target 56 may be configured to rotate such that the electron beam 64 striking the target 56 does not cause the target 56 to melt since the electron beam 64 does not strike the target 56 at the same location. In another embodiment, the target 56 may include a stationary target. Furthermore, the target 56 may be made of a material that is capable of withstanding the heat generated by the impact of the electron beam 64. For example, the target 56 may include materials such as, but not limited to, tungsten, molybdenum, or copper.

In the presently contemplated configuration, the emitter 58 is a flat emitter. In an alternative configuration the emitter 58 may be a curved emitter. The curved emitter, which is typically concave in curvature, provides pre-focusing of the electron beam. As used herein, the term "curved emitter" may be used to refer to the emitter that has a curved emission surface. Furthermore, the term "flat emitter" may be used to refer to an emitter that has a flat emission surface. In accordance with aspects of the present technique shaped emitters may also be employed. For example, in one embodiment, various polygonal shaped emitters such as, a square emitter, or a rectangular emitter may be employed. However, other such shaped emitters such as, but not limited to elliptical or circular emitters may also be employed. It may be noted that emitters of different shapes or sizes may be employed based on the application requirements.

In accordance with aspects of the present technique, the emitter 58 may be formed from a low work-function material. More particularly, the emitter 58 may be formed from a material that has a high melting point and is capable of stable electron emission at high temperatures. The low work-function material may include materials such as, but not limited to, tungsten, thoriated tungsten, lanthanum hexaboride, and the like.

With continuing reference to FIG. 3, the injector 52 may include at least one focusing electrode 70. In one embodiment, the at least one focusing electrode 70 may be disposed adjacent to the emitter 58 such that the focusing electrode 70 focuses the electron beam 64 towards the target 56. As used herein, the term "adjacent" means near to in space or position. Further, in one embodiment, the focusing electrode 70 may be maintained at a voltage potential that is less than a voltage potential of the emitter 58. The potential difference between the emitter 58 and focusing electrode 70 prevents electrons generated from the emitter 58 from moving towards the focusing electrode 70. In one embodiment, the focusing electrode 70 may be maintained at a negative potential with respect to that of the emitter 58. The negative potential of the focusing electrode 70 with respect to the emitter 58 focuses the electron beam 64 away from the focusing electrode 70 and thereby facilitates focusing of the electron beam 64 towards the target 56.

In another embodiment, the focusing electrode 70 may be maintained at a voltage potential that is equal to or substantially similar to the voltage potential of the emitter 58. The similar voltage potential of the focusing electrode 70 with respect to the voltage potential of the emitter 58 creates a parallel electron beam by shaping electrostatic fields due to the shape of the focusing electrode 70. The focusing electrode 70 may be maintained at a voltage potential that is equal to or substantially similar to the voltage potential of the emitter 58 via use of a lead (not shown in FIG. 3) that couples the emitter 58 and the focusing electrode 70.

Moreover, in accordance with aspects of the present technique, the injector 52 includes at least one extraction electrode 74 for additionally controlling and focusing the electron beam 64 towards the target 56. In one embodiment, the at least one extraction electrode 74 is located between the target 56 and the emitter 58. Furthermore, in certain embodiments, the extraction electrode 74 may be positively biased via use of a voltage tab (not shown in FIG. 3) for supplying a desired voltage to the extraction electrode 74. In accordance with aspects of the present technique, a bias voltage power supply 90 may supply a voltage to the extraction electrode 74 such that the extraction electrode 74 is maintained at a positive bias voltage with respect to the emitter 58. In one embodiment, the extraction electrode 74 may be divided into a plurality of regions having different voltage potentials to perform focusing or a biased emission from different regions of the emitter 58.

It may be noted that, in an X-ray tube, energy of an X-ray beam may be controlled via one or more of multiple ways. For instance, the energy of an X-ray beam may be controlled by altering the potential difference (that is acceleration voltage) between the cathode and the anode, or by changing the material of the X-ray target, or by filtering the electron beam. This is generally referred to as "kV control." As used herein, the term "electron beam current" refers to the flow of electrons per second between the cathode and the anode. Furthermore, an intensity of the X-ray beam is controllable via control of the electron beam current. Such a technique of controlling the intensity is generally referred to as "mA control." As discussed herein, aspects of the present technique provide for control of the electron beam current via use of the extraction electrode 74. It may be noted that, the use of such extraction electrode 74 enables a decoupling of the control of electron emission from the acceleration voltage.

Furthermore, the extraction electrode 74 is configured for microsecond current control. Specifically, the electron beam current may be controlled in the order of microseconds by altering the voltage applied to the extraction electrode 74 in the order of microseconds. It may be noted that the emitter 58 may be treated as an infinite source of electrons. In accordance with aspects of the present technique, electron beam current, which is typically a flow of electrons from the emitter 58 towards the target 56, may be controlled by altering the voltage potential of the extraction electrode 74. Control of the electron beam current will be described in greater detail hereinafter.

With continuing reference to FIG. 3, the extraction electrode 74 may also be biased at a positive voltage with respect to the focusing electrode 70. As an example, if the voltage potential of emitter 58 is about −140 kV, the voltage potential of the focusing electrode 70 may be maintained at about −140 kV or less, and the voltage potential of the extraction electrode 74 may be maintained at about −135 kV for positively biasing the extraction electrode 74 with respect to the emitter 58. In accordance with aspects of the present technique, an electric field 76 is generated between the extraction electrode 74 and the focusing electrode 70 due to a potential difference between the focusing electrode 70 and the extraction electrode 74. The strength of the electric field 76 thus generated may be employed to control the intensity of electron beam 64 generated by the emitter 58 towards the target 56. The intensity of the electron beam 64 striking the target 56 may thus be controlled by the electric field 76. More particularly, the electric field 76 causes the electrons emitted from the emitter 58 to be accelerated towards the target 56. The stronger the electric field 76, the stronger is the acceleration of the electrons from the emitter 58 towards the target 56. Alternatively, the weaker the electric field 76, the lesser is the acceleration of electrons from the emitter 58 towards the target 56.

In addition, altering the bias voltage on the extraction electrode 74 may modify the intensity of the electron beam 64. As previously noted, the bias voltage on the extraction electrode may be altered via use of the voltage tab present on the bias voltage power supply 90. Biasing the extraction electrode 74 more positively with respect to the emitter 58 results in increasing the intensity of the electron beam 64. Alternatively, biasing the extraction electrode 74 less positively with respect to the emitter 58 causes a decrease in the intensity of the electron beam 64. In one embodiment, the electron beam 64 may be shut-off entirely by biasing the extraction electrode 74 negatively with respect to the emitter 58. As previously noted, the bias voltage on the extraction electrode 74 may be supplied via use of the bias voltage power supply 90. Hence, the intensity of the electron beam 64 may be controlled from 0 percent to 100 percent of possible intensity by changing the bias voltage on the extraction electrode 74 via use of the voltage tab present in the bias voltage power supply 90.

Furthermore, voltage shifts of 8 kV or less may be applied to the extraction electrode 74 to control the intensity of the electron beam 64. In certain embodiments, these voltage shifts may be applied to the extraction electrode 74 via use of a control electronics module 92. The control electronics module 92 changes the voltage applied to the extraction electrode 74 in intervals of 1-15 microseconds to intervals of about at least 150 milliseconds. In one embodiment, the control electronics module 92 may include Si switching technology circuitry to change the voltage applied to the extraction electrode 74. In certain embodiments, where the voltage shifts range beyond 8 kV, a silicon carbide (SiC) switching technology may be applied. Accordingly, changes in voltage applied to the extraction electrode 74 facilitates changes in intensity of the electron beam 64 in intervals of 1-15 microseconds, for example. This technique of controlling the intensity of the electron beam in the order of microseconds may be referred to as microsecond intensity switching.

Additionally, the exemplary X-ray tube 50 may also include a magnetic assembly 80 for focusing and/or positioning and deflecting the electron beam 64 on the target 56. In one embodiment, the magnetic assembly 80 may be disposed between the injector 52 and the target 56. In one embodiment, the magnetic assembly 80 may include one or more multipole magnets for influencing focusing of the electron beam 64 by creating a magnetic field that shapes the electron beam 64 on the X-ray target 56. The one or more multipole magnets may include one or more quadrupole magnets, one or more dipole magnets, or combinations thereof. As the properties of the electron beam current and voltage change rapidly, the effect of space charge and electrostatic focusing in the injector will change accordingly. In order to maintain a stable focal spot size, or quickly modify focal spot size according to system requirements, the magnetic assembly 80 provides a magnetic field having a performance controllable from steady-state to a sub-30 microsecond time scale for a wide range of focal spot sizes. This provides protection of the X-ray source system, as well as achieving CT system performance requirements. Additionally, the magnetic assembly 80 may include one or more dipole magnets for deflection and positioning of the electron beam 64 at a desired location on the X-ray target 56. The electron beam 64 that has been focused and positioned impinges upon the target 56 to generate the X-rays 84. The X-rays 84 generated by collision of the electron beam 64 with the target 56 may be directed from the X-ray tube 50 through an opening in the tube casing 72, which may be generally referred to as an X-ray window 86, towards an object (not shown in FIG. 3).

With continuing reference to FIG. 3, the electrons in the electron beam 64 may get backscattered after striking the target 56. Therefore, the exemplary X-ray tube 50 may include an electron collector 82 for collecting electrons that are backscattered from the target 56. In accordance with aspects of the present technique, the electron collector 82 may be maintained at a ground potential. In an alternative embodiment, the electron collector 82 may be maintained at a potential that is substantially similar to the potential of the target 56. Further, in one embodiment, the electron collector 82 may be located adjacent to the target 56 to collect the electrons backscattered from the target 56. In another embodiment, the electron collector 82 may be located between the extraction electrode 74 and the target 56, close to the target 56. In addition, the electron collector 82 may be formed from a refractory material, such as, but not limited to, molybdenum. Furthermore, in one embodiment, the electron collector 82 may be formed from copper. In another embodiment, the electron collector 82 may be formed from a combination of a refractory metal and copper.

Furthermore, it may be noted that the exemplary X-ray tube 50 may also include a positive ion collector (not shown in FIG. 3) to attract positive ions that may be produced due to collision of electrons in the electron beam 64 with the target 56. The positive ion collector is generally placed along the electron beam path and prevents the positive ions from striking various components in the X-ray tube 50, thereby preventing damage to the components in the X-ray tube 50.

Figure 4:
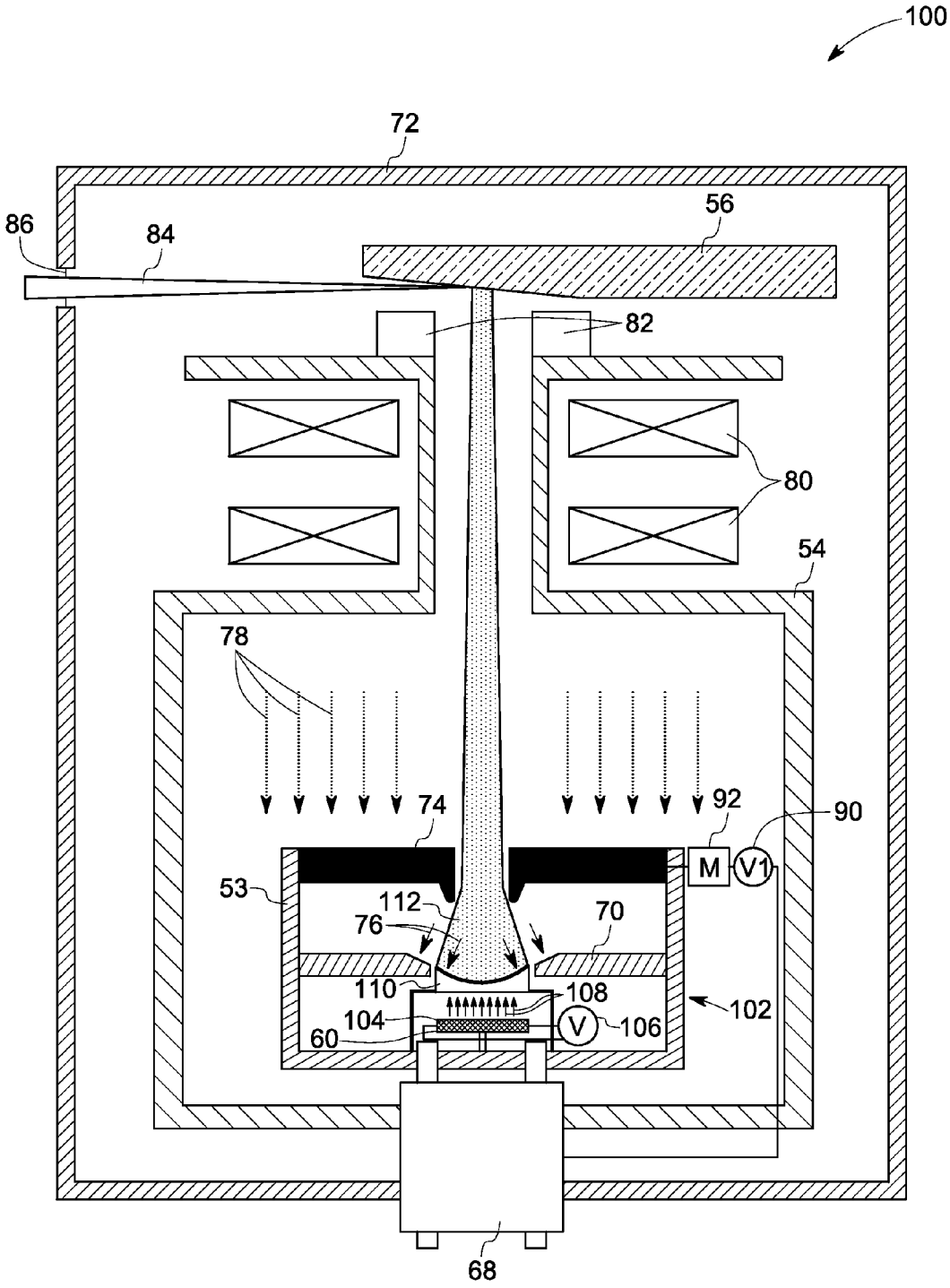
FIG. 4 is a diagrammatical illustration of another exemplary X-ray tube, in accordance with aspects of the present technique.

Referring now to FIG. 4, a diagrammatical illustration of another embodiment of an exemplary X-ray tube 100 is presented. As illustrated in the present embodiment, the X-ray tube 100 includes an exemplary injector 102 disposed within the vacuum wall 54. Further, the injector 102 includes the injector wall 53 that encloses various components of the injector 102. As with the X-ray tube 50, the X-ray tube 100 also includes the anode 56.

In accordance with aspects of the present technique, the injector 102 may include an indirectly heated cathode. Accordingly, in the embodiment illustrated in FIG. 4, the injector 102 includes an indirectly heated cathode such as an emitter 110. In the presently contemplated configuration, the emitter 110 is a curved emitter. Furthermore, in the present example, the indirectly heated cathode, such as the emitter 110, may be heated by at least one thermionic electron source 104. The at least one thermionic electron source 104 includes an emission plane that emits electrons when subjected to appropriate heating conditions. In accordance with aspects of the present technique, the emission plane may include a circular, a rectangular, an elliptical, or a square geometry, or combinations thereof. Furthermore, it may be noted that the emission plane may include at least one coil filament, a ribbon, a flat plane, or combinations thereof. The thermionic electron source 104 may be configured to generate electrons in response to a flow of electron current through the at least one thermionic electron source 104. The electron current increases the temperature of the thermionic electron source 104 due to Joule heating. Also, the thermionic electron source 104 may be formed from a material that has a high melting point and is capable of stable electron emission at high temperatures. Additionally, in one embodiment, the thermionic electron source 104 may be formed from a low work-function material. In one embodiment, the thermionic electron source 104 may include a low work-function material coating. More particularly, the thermionic electron source 104 may be formed from materials capable of generating electrons upon heating, such as, but not limited to, tungsten, thoriated tungsten, tungsten rhenium, molybdenum, and the like. Additionally, in one embodiment, the thermionic electron source 104 may be heated by applying a voltage to the thermionic source 104 via a filament lead (not shown in FIG. 4). In certain embodiments, a first voltage source 106 may be used to apply the voltage to the thermionic electron source 104. The electrons generated by the thermionic electron source 104 may generally be referred to as a heating electron beam 108.

The emitter 110 when impinged upon by the heating electron beam 108 generates an electron beam 112. The electron beam 112 may be directed towards the target 56 to produce X-rays 84. More particularly, the electron beam 112 may be accelerated from the emitter 110 towards the target 56 by applying a potential difference between the emitter 110 and the target 56. Further, as depicted in a presently contemplated configuration of FIG. 4, the emitter 110 is a curved emitter coupled to the emitter support 60, and the emitter support 60 in turn is coupled to the injector wall 53, as previously noted. However, the emitter 110 need not be curved but instead may have a flat emission surface. In one embodiment, the emitter 110 may be made of a low work-function material. Alternatively, the emitter 110 may include a low-work function material having a work function lower than tungsten that emits electrons on heating. More particularly, the emitter 110 may be formed from a material that has a high melting point and is capable of stable electron emission at high temperatures, such as, but not limited to, tungsten, thoriated tungsten, lanthanum hexaboride, and the like. In the presently contemplated configuration of an indirectly heated cathode, such as the emitter 110, the design of a curved emitter may be achieved. Also, thermal run away in the emitter 110 may be caused when heat from the emitter 110 flows back to the thermionic electron source 104. The thermal run away may be avoided by operating the thermionic electron source 104 in a space charge limited regime instead of a temperature limited regime. The space charge limited regime is formed when emission of electrons from the emitter 110 is limited by an electric field formed on a surface of the emitter 110 rather than the temperature of the emitter 110.

As previously noted with reference to FIG. 3, the focusing electrode 70 and the extraction electrode 74 may be employed to accelerate the electrons emitted from the emitter 110 and direct the electron beam 112 towards the target 56. Furthermore, use of the focusing electrode 70 and the extraction electrode 74 facilitates control of intensity of the electron beam 112. As previously noted with reference to FIG. 3, the extraction electrode 74 is maintained at a positive bias voltage with respect to the emitter 110 and the focusing electrode 70. This facilitates controlling the intensity of the electron beam 112 striking the target 56. The electron beam 112 on impinging the target 56 produces the X-rays 84.

The embodiments of exemplary X-ray tube as described hereinabove have several advantages such as microsecond current control of the electron beam. The exemplary X-ray tube may also be used to improve fast kV switching by boosting the low kV signal. Further, the exemplary X-ray tube may increase low kV emission level by decoupling emission and acceleration of the electron beam. Additionally, focal spot size, and intensity and position of the electron beam may be maintained in the exemplary X-ray tube resulting in improved image quality of the CT imaging system.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. An injector for an X-ray tube, comprising:

an emitter to emit an electron beam;

at least one focusing electrode disposed around the emitter, wherein the at least one focusing electrode focuses the electron beam; and at least one extraction electrode disposed around the electron beam, focused by the at least one focusing electrode, maintained at a positive bias voltage with respect to the emitter and with respect to the at least one focusing electrode, wherein the at least one extraction electrode controls an intensity of the electron beam.

2. The injector of claim 1 further comprising:

at least one thermionic electron source for generating a heating electron beam to impinge the emitter so as to generate the electron beam.

3. The injector of claim 1, wherein the emitter comprises a low work-function material having a work function lower than tungsten.

4. The injector of claim 1, wherein the emitter is a curved emitter.

5. The injector of claim 1, wherein the emitter is a flat emitter.

6. The injector of claim 1, wherein the focusing electrode is biased at a negative voltage with respect to the extraction electrode.

7. The injector of claim 2, wherein the at least one thermionic electron source comprises an emission plane.

8. The injector of claim 7, wherein the emission plane comprises at least one coil filament, a ribbon, a flat plane, or combinations thereof.

9. The injector of claim 7, wherein the emission plane comprises a polygonal, circular or elliptical shape.

10. The injector of claim 2, wherein the at least one thermionic electron source comprises a low work-function material having a work function lower than tungsten.

11. The injector of claim 1 further comprising: applying a negative bias voltage on the at least one extraction electrode to shut-off the electron beam.

12. An X-ray tube, comprising:

an injector, comprising:

an emitter for generating an electron beam;

at least one focusing electrode for focusing the electron beam;

at least one extraction electrode disposed around the electron beam, focused by the at least one focusing electrode, for controlling an intensity of the electron beam, wherein the at least one extraction electrode is maintained at a positive bias voltage with respect to the emitter and with respect to the at least one focusing electrode, wherein an electric field is generated between the at least one focusing electrode and the at least one extraction electrode, which controls the intensity of the electron beam;

a target for generating X-rays when impinged upon by the electron beam; and a magnetic assembly located between the injector and the target for focusing the electron beam towards the target.

13. The X-ray tube of claim 12, wherein the target is maintained at a ground potential.

14. The X-ray tube of claim 12, wherein the target is maintained at a positive potential with respect to ground potential and the cathode is maintained at a negative potential with respect to ground.

15. The X-ray tube of claim 14, wherein the emitter is maintained at a ground potential.

16. The X-ray tube of claim 12, further comprising:

at least one thermionic electron source for generating a heating electron beam to impinge the emitter so as to generate the electron beam.

17. The X-ray tube of claim 12, further comprising an electron collector for collecting electrons that are backscattered from the target.

18. The X-ray tube of claim 17, wherein the electron collector is maintained at a ground potential or at a voltage potential of the target.

19. The X-ray tube of claim 12, wherein the magnetic assembly comprises one or more multipole magnets.

20. The X-ray tube of claim 19, wherein the one or more multipole magnets comprise one or more quadrupole magnets, one or more dipole magnets, or combinations thereof.

21. The X-ray tube of claim 12, wherein an intensity of the electron beam is controlled via an electric field generated between the focusing electrode and the extraction electrode.

22. A computed tomography system, comprising;

a gantry;

an X-ray tube coupled to the gantry, the X-ray tube comprising:

a tube casing;

an injector comprising:

an emitter for generating an electron beam;

at least one focusing electrode for focusing the electron beam;

at least one extraction electrode disposed around the electron beam, focused by the at least one focusing electrode, for controlling an intensity of the electron beam, wherein the at least one extraction electrode is maintained at a positive bias voltage with respect to the emitter and with resect to the at least one focusing electrode wherein an electric field is generated between the at least one focusing electrode and the at least one extraction electrode, which controls the intensity of the electron beam;

a target for generating X-rays when impinged upon by the electron beam;

a magnetic assembly located between the injector and the target for focusing the electron beam towards the target;

an X-ray controller for providing power and timing signals to the X-ray tube; and one or more detector elements for detecting attenuated X-ray beam from an imaging object.

23. An injector for an X-ray tube, comprising:

an emitter to emit an electron beam;

at least one focusing electrode disposed around the emitter, wherein the at least one focusing electrode focuses the electron beam;

at least one extraction electrode disposed around the electron beam, focused by the at least one focusing electrode, and maintained at a positive bias voltage with respect to the emitter and with respect to the at least one focusing electrode, wherein an electric field is generated between the at least one focusing electrode and the at least one extraction electrode, which controls an intensity of the electron beam;

a voltage power supply coupled to the at least one extraction electrode; and a voltage controller to control a voltage supplied to the at least one extraction electrode to control a strength of the electric field.

* * * * *